US006494210B1

(12) United States Patent
Mams

(10) Patent No.: US 6,494,210 B1
(45) Date of Patent: Dec. 17, 2002

(54) METHOD OF ADVERTISING WITH A MOUTHGUARD

(76) Inventor: Frank L. Mams, 113 Red Oak La., P.O. Box 1924, Elkins, WV (US) 26241

( * ) Notice: Subject to any disclaimer, the term of this patent is extended or adjusted under 35 U.S.C. 154(b) by 0 days.

(21) Appl. No.: 09/797,611

(22) Filed: Mar. 5, 2001

(51) Int. Cl.[7] ..... A61C 5/14
(52) U.S. Cl. ..... 128/859; 128/861
(58) Field of Search ..... 128/846, 848, 128/859–862; 602/902; 433/6

(56) References Cited

U.S. PATENT DOCUMENTS 3,333,582 A 8/1967 Cathcart
5,234,005 A * 8/1993 Kittelsen ..... 128/859
5,385,155 A * 1/1995 Kittelson ..... 128/861
5,566,684 A * 10/1996 Wagner ..... 128/862
5,601,093 A 2/1997 Sheehan
D383,209 S 9/1997 Duran
5,718,243 A 2/1998 Weatherford et al.
D408,919 S 4/1999 Cooley
6,321,752 B1 * 11/2001 Spottiswoode ..... 128/861

* cited by examiner

*Primary Examiner*—Michael A. Brown

(57) ABSTRACT

A method of advertising with a mouthguard for providing a mouthguard for protecting the teeth of a wearer and for advertising. The method of advertising with a mouthguard includes providing a mouthguard having a bottom wall with a generally U-shaped configuration. An outer wall and an inner wall being coupled to and extending up from the bottom wall such that teeth of a user may be positioned between the outer and inner wall. Securing indicia on an outer surface of the outer wall of the mouthguard such that the indicia is visible when the mouthguard is in a user's mouth.

1 Claim, 1 Drawing Sheet

METHOD OF ADVERTISING WITH A MOUTHGUARD

BACKGROUND OF THE INVENTION

1. Field of the Invention

The present invention relates to mouthguards and more particularly pertains to a new method of advertising with a mouthguard for providing a mouthguard for protecting the teeth of a wearer and for advertising.

2. Description of the Prior Art

The use of mouthguards is known in the prior art. More specifically, mouthguards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,234,005; 5,718,243; 5,601,093; 408,919; U.S. Des. Pat. No. 383,209; and U.S. Pat. No. 3,333,582.

While these devices fulfill their respective, particular objectives and requirements, the aforementioned patents do not disclose a new method of advertising with a mouthguard. The inventive device includes providing a mouthguard having a bottom wall with a generally U-shaped configuration. An outer wall and an inner wall being coupled to and extending up from the bottom wall such that teeth of a user may be positioned between the outer and inner wall. Securing indicia on an outer surface of the outer wall of the mouthguard such that the indicia is visible when the mouthguard is in a user's mouth.

In these respects, the method of advertising with a mouthguard according to the present invention substantially departs from the conventional concepts and designs of the prior art, and in so doing provides an apparatus primarily developed for the purpose of providing a mouthguard for protecting the teeth of a wearer and for advertising.

SUMMARY OF THE INVENTION

In view of the foregoing disadvantages inherent in the known types of mouthguards now present in the prior art, the present invention provides a new method of advertising with a mouthguard construction wherein the same can be utilized for providing a mouthguard for protecting the teeth of a wearer and for advertising.

The general purpose of the present invention, which will be described subsequently in greater detail, is to provide a new method of advertising with a mouthguard apparatus and method which has many of the advantages of the mouthguards mentioned heretofore and many novel features that result in a new method of advertising with a mouthguard which is not anticipated, rendered obvious, suggested, or even implied by any of the prior art mouthguards, either alone or in any combination thereof.

To attain this, the present invention generally comprises providing a mouthguard having a bottom wall with a generally U-shaped configuration. An outer wall and an inner wall being coupled to and extending up from the bottom wall such that teeth of a user may be positioned between the outer and inner wall. Securing indicia on an outer surface of the outer wall of the mouthguard such that the indicia is visible when the mouthguard is in a user's mouth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method of advertising with a mouthguard apparatus and method which has many of the advantages of the mouthguards mentioned heretofore and many novel features that result in a new method of advertising with a mouthguard which is not anticipated, rendered obvious, suggested, or even implied by any of the prior art mouthguards, either alone or in any combination thereof.

It is another object of the present invention to provide a new method of advertising with a mouthguard which may be easily and efficiently manufactured and marketed.

It is a further object of the present invention to provide a new method of advertising with a mouthguard which is of a durable and reliable construction.

An even further object of the present invention is to provide a new method of advertising with a mouthguard which is susceptible of a low cost of manufacture with regard to both materials and labor, and which accordingly is then susceptible of low prices of sale to the consuming public, thereby making such method of advertising with a mouthguard economically available to the buying public.

Still yet another object of the present invention is to provide a new method of advertising with a mouthguard which provides in the apparatuses and methods of the prior art some of the advantages thereof, while simultaneously overcoming some of the disadvantages normally associated therewith.

Still another object of the present invention is to provide a new method of advertising with a mouthguard for providing a mouthguard for protecting the teeth of a wearer and for advertising.

Yet another object of the present invention is to provide a new method of advertising with a mouthguard which includes providing a mouthguard having a bottom wall with a generally U-shaped configuration. An outer wall and an inner wall being coupled to and extending up from the bottom wall such that teeth of a user may be positioned between the outer and inner wall. Securing indicia on an outer surface of the outer wall of the mouthguard such that the indicia is visible when the mouthguard is in a user's mouth.

Still yet another object of the present invention is to provide a new method of advertising with a mouthguard that provides additional advertising space in a very visible and heretofore unused medium.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
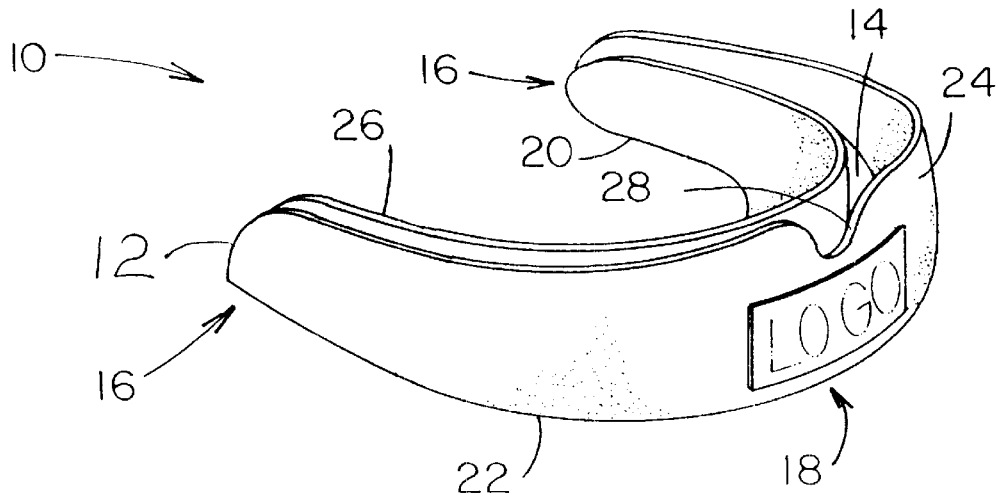
FIG. 1 is a schematic perspective view of a new method of advertising with a mouthguard according to the present invention.
Figure 2:
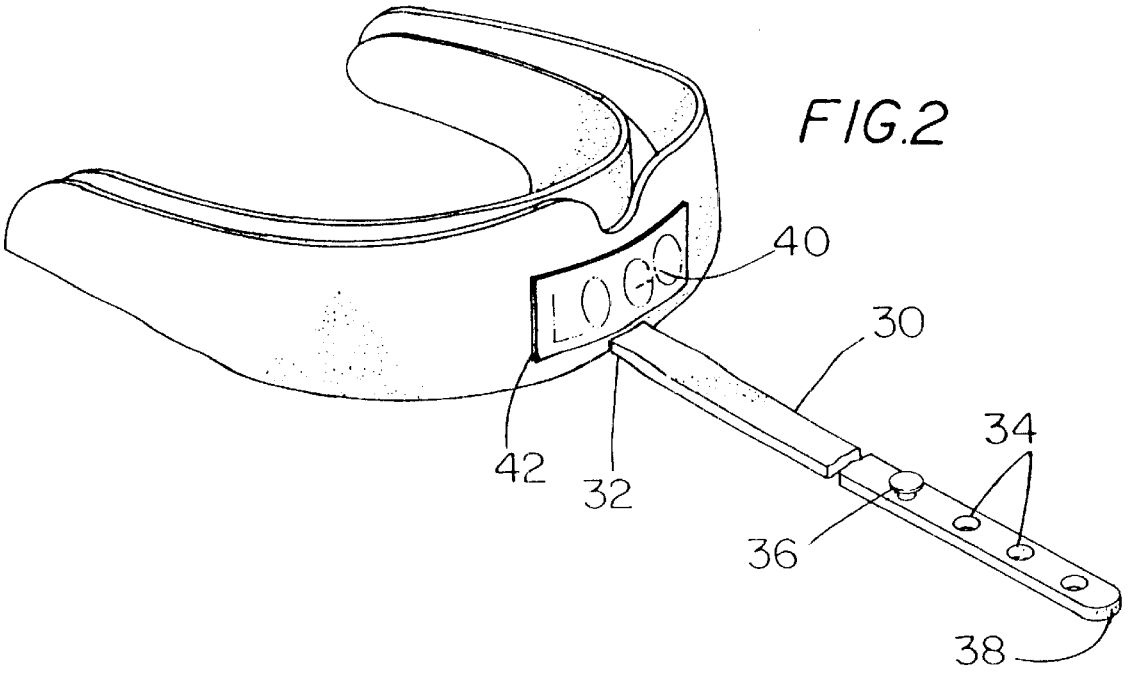
FIG. 2 is a schematic perspective view of the present invention.

With reference now to the drawings, and in particular to FIGS. 1 and 2 thereof, a new method of advertising with a mouthguard embodying the principles and concepts of the present invention and generally designated by the reference numeral 10 will be described.

As best illustrated in FIGS. 1 and 2, the method of advertising with a mouthguard 10 generally comprises a mouthguard 12 having a bottom wall 14 with a generally U-shaped configuration such that a pair of legs 16 and a middle portion 18 is defined. Each of the legs 16 and middle portion 18 has an inner edge 20 and an outer edge 22. An outer wall 24 extends along and upwardly away from the outer edge 22 of the legs 16 and the middle portion 18. An inner wall 26 extends along and upwardly away from the inner edge 20 of the legs 16 and the middle portion 18. Teeth of a user of the mouthguard are positioned between the inner 26 and outer 24 walls. The outer wall 24 has a top edge having an arcuate slot 28 therein positioned generally above the middle portion 18 of the bottom wall 14. The mouthguard 12 is adapted for positioning in the mouth of a user and comprises a generally conventional mouthguard. The mouthguard 12 preferably comprises a plastic material.

Preferably, a flexible elongate member 30 has a first end 32 attached to the outer edge 22 of the middle portion 18 and extends away from the mouthguard 12. The elongate member 30 has a plurality of aligned holes 34 extending therethrough. A nub 36 is attached to the elongate member 30 and is located generally nearer a second end 38 than the first end 32 of the elongate member 30. The nub 36 may be extended into and frictionally engage one of the holes 34 to define a loop. The loop may be secured to athletic equipment for holding the mouthguard when not in use.

Indicia 40 are secured on an outer surface of the outer wall 24 of the middle portion of the mouthguard 12 such that the indicia 40 are visible when the mouthguard 12 is in a user's mouth. The indicia preferably comprise logo indicia coupled to a panel 42, which is attached to the outer wall 24. The logo indicia may be positioned on the mouthguard in any conventionally known manner, or may be molded into the mouthguard.

In use, the mouthguard 12 is worn as a traditional mouthguard, such as those used by football players. The logo indicia 40 are positioned in the front of the mouthguard such that the indicia are seen when the users have the mouthguard 12 in. Advertisers may thus use this area of the mouthguard 12 for advertising their products.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mouthguard device comprising:

a mouthguard having a bottom wall having a generally U-shaped configuration, an outer wall and an inner wall being coupled to said bottom wall such that teeth of a user may be positioned between said outer and inner wall, said outer wall having a top edge having an arcuate slot therein positioned generally above said middle portion of said bottom wall;

logo indicia being position on an outer surface of said outer wall of said mouthguard such that said indicia is visible when said mouthguard is in a user's mouth, said logo indicia being coupled to a panel attached to the outer surface of said outer wall of said mouthguard, said panel having a substantially rectangular perimeter edge.

* * * * *